US010737916B2

(12) United States Patent
Grapes et al.

(10) Patent No.: US 10,737,916 B2
(45) Date of Patent: Aug. 11, 2020

(54) MANUAL MARINE WINCH WITH SAFETY LOADING HANDLE AND INTEGRATED LOCKING DOG RELEASE

(71) Applicant: W. W. Patterson Company, Pittsburgh, PA (US)

(72) Inventors: Taylor C Grapes, Pittsburgh, PA (US); Brandon Cox, West Newton, PA (US)

(73) Assignee: W. W. PATTERSON COMPANY, Pittsburgh, PA (US)

( * ) Notice: Subject to any disclaimer, the term of this patent is extended or adjusted under 35 U.S.C. 154(b) by 811 days.

(21) Appl. No.: 15/187,153

(22) Filed: Jun. 20, 2016

(65) Prior Publication Data

US 2017/0362066 A1 Dec. 21, 2017

(51) Int. Cl.
*B66D 1/06* (2006.01)

(52) U.S. Cl.
CPC ..... *B66D 1/06* (2013.01)

(58) Field of Classification Search
CPC ..... B66D 1/06; B66D 5/32
See application file for complete search history.

(56) References Cited

U.S. PATENT DOCUMENTS

| | | | | |
|---|---|---|---|---|
| 1,051,272 | A * | 1/1913 | Samuell | B66D 1/06 254/357 |
| 2,755,674 | A * | 7/1956 | Archer | B66D 1/06 254/111 |
| 3,868,091 | A * | 2/1975 | Hoffman | B66D 1/06 254/369 |
| 3,939,729 | A | 2/1976 | Brockelsby | |
| 4,106,754 | A | 8/1978 | Kucher | |
| 4,456,227 | A | 6/1984 | Notenboom | |
| 4,566,674 | A | 1/1986 | Ebey et al. | |
| 5,947,450 | A | 9/1999 | Grapes | |
| 6,431,525 | B1 | 8/2002 | Roll | |
| 6,572,083 | B1 | 6/2003 | Topping, Jr. et al. | |
| 6,726,182 | B2 | 4/2004 | Topping, Jr. et al. | |
| 6,938,881 | B2 | 9/2005 | Grapes | |

(Continued)

FOREIGN PATENT DOCUMENTS

| | | | | |
|---|---|---|---|---|
| DE | 2809936 B1 * | 5/1979 | ..... | B60P 7/083 |
| GB | 126922 A * | 5/1919 | ..... | B66D 1/06 |

OTHER PUBLICATIONS

Translation of DE-2809936-B1, espacenet.com (Year: 2018).*

*Primary Examiner* — Sang K Kim
*Assistant Examiner* — Nathaniel L Adams
(74) *Attorney, Agent, or Firm* — Blynn L. Shideler; Krisanne Shideler; BLK Law Group

(57) ABSTRACT

A manual marine winch includes a safety loading handle and integrated locking dog release. The winch includes a handle for selectively tensioning and selectively releasing tension on winch; a tensioning ratchet gear coupled to the drum assembly for selectively tensioning the winch; a tensioning ratchet pawl mounted on the handle and selectively engaged with the tensioning ratchet gear for tensioning of the winch; at least one tension holding ratchet gear coupled to the drum assembly for holding tension on the winch; at least one locking dog pawl selectively engaged with each tension holding ratchet gear to hold tension on the winch; and a knockout member carried on the handle and configured to selectively disengage the locking dog pawls from the tension holding ratchet gears to allow for release of tension on the winch.

8 Claims, 4 Drawing Sheets

(56) References Cited

U.S. PATENT DOCUMENTS

| | | | | |
|---|---|---|---|---|
| 7,128,307 | B2 | 10/2006 | Dow | |
| 7,179,852 | B2 | 2/2007 | Schultes et al. | |
| 7,686,282 | B2 | 3/2010 | Amoss et al. | |
| 7,909,306 | B2 * | 3/2011 | Adcock ..... | B60P 7/083 24/68 R |
| 9,004,456 | B2 | 4/2015 | Topping, Jr. et al. | |
| 2012/0068132 | A1 | 3/2012 | Grapes et al. | |

* cited by examiner

MANUAL MARINE WINCH WITH SAFETY LOADING HANDLE AND INTEGRATED LOCKING DOG RELEASE

BACKGROUND OF THE INVENTION

1. Field of the Invention

The present invention relates to manual winches with safe knockout tension release mechanisms, more particularly, the present invention relates to manual marine winches with a safety loading handle and integrated locking dog release.

2. Background Information

General Manual Marine Winches

Winches have been used in many applications. The present invention relates to manual winches which have been widely used in barges, tow boats and the like. Typically such a manual winch is attached to a boat deck and spools a towing cable or winch line on a rotating drum.

Manual winches remain in common use where a powered winch would be impractical or inefficient. In a manual winch the operator, through various mechanical advantages, can generate a very large tension on the winch line. Examples of manual winches are described in greater detail in U.S. Pat. No. 5,947,450 which is incorporated herein by reference. Examples of manual winches are sold by W. W. Patterson Company, Nabrico and Nashville Bridge Company. Other representative examples are found in U.S. Pat. Nos. 3,939,729; 4,106,754; 4,456,227; 4,566,674; 6,431,525; 6,572,083; 6,726,182; 6,938,881; 7,128,307; 7,179,852; 7,686,282, which are incorporated herein by reference.

A background summary of conventional winch design may be helpful to fully understand the scope and operation of the present invention.

The conventional prior art manual marine winch is described in U.S. Pat. No. 5,947,450 and includes a base plate and a pair of spaced side plates surrounding a rotatable spool or drum assembly. The rotatable spool assembly is rotationally supported between the side plates and includes a drum with a controlling gear. A control assembly is supported by the side plates and engages with the gear to rotate the drum for spooling of a cable (not shown) or wire rope or winch line thereon. The control assembly includes a hand wheel and an actuating lever or handle, also called a ratchet handle, each of which are used for manually operating the winch.

A foot brake may be attached to the side plate through which the control assembly extends. The foot brake, if provided, is adapted to frictionally engage the hand wheel. A swivel link may be attached to the base plate at a rear of the winch and pivotally attaches the winch to a D-ring of a boat deck or the like. The construction of the manual swivel winch may include the use of four tubular spacers for spacing the side plates apart. A bolt extends through the center of each spacer through aligned holes in the opposed side plates and is secured by nuts.

In a conventional marine winch a wire rope, the winch line, is spooled back and forth around the rotating drum and the winch line is subject to very large loads. The high loading can cause the outer layers of wire rope to become fouled, jammed or begin binding within the spaces between the lower level wire ropes. Further, rapid tension release in existing wire rope winch systems can result in what is known as "bird-nesting" of the spooled wire rope. This can make unwinding the winch very difficult in subsequent operation, and often requires a second deck hand to assist in the unwinding of the wire rope, or even the engine power of the tow boat. U.S. Pat. No. 7,543,800 which is incorporated herein by reference addressed some of these problems with the design and implementation of a "single stack" winch.

The conventional ratchet handle of the above describe marine winches will typically have a stowed position, generally the rearward position, in which it is disengaged from the gearing associated with the drum. The stowed position may have a stop secured to the sidewall or side plate acting as a rest for the handle and a visual indicator that the handle is in the stowed position. As the handle is rotated away from the stowed position it will engage the gearing associated with the drum to allow for tensioning of the drum and associated winch line, in a conventional fashion known in the art.

The tension is held on ratchet gears that are engaged with pawls or locking dogs. In conventional tensioning operation for the winch the pawls are engaged with the ratchet gears and the operator will rapidly wind up the winch line, and increase the tension, initially through the operation of the hand wheel. Once the tension reaches a relatively high amount on the winch line, the operator will continue the tensioning through the repeated use of the ratchet handle, often with the use of a handle extension or a "cheater bar" to add increased leverage. Once the final tension is achieved it is intended for the operator to move the handle to the disengaged or stowed position, typically the rearward position, to prepare the winch for tension release when desired.

A knockout lever, also known in the art, is used to disengage the pawls or dogs from the gears to release tension on the winch, when desired. When controlled payout is desired the footbrake, if provided, is engaged (or the hand wheel is gripped) and the knockout lever is utilized to disengage the pawls or dogs from the gears to allow for slow payout. Often the tension release is allowed to be somewhat rapid. The knockout lever is so named as it is often struck to be knocked out of engagement.

Dangerous Unintentional Handle Rotation with Knockout Operation of Conventional Manual Winch Designs The manual tensioning handles of known marine winches should be disengaged to allow for safe unloading or payout of the winch line. If the tension is released on the drum through a knockout device with the handle still accidentally engaged, the handle naturally will rotate, through the gearing, with the drum. In such a case, with the drum under high loads or tension, the accidentally drum-engaged handle can be rotated quite fast and violently before striking a rear stop or the ship's deck. Aside to damaging the handles in this movement, of far greater concern is the potential injury to workers around the winch during such accidental winch handle movement.

The danger of unintended handle movement is only heightened if a handle extension, also called a cheater bar, is left on the handle that is left engaged with the gearing. A cheater bar is merely a length of pipe that operators have been known to add to the manual marine winch handle to increase the effective lever arm available to the operator for ease of tensioning the winch 10 or 50. Operators have broken arms and legs due to such undesired violent handle and cheater bar motion during knockout operation.

U.S. Patent Application Publication No. 2012-0068132, which is incorporated herein by reference, provides one solution to this handle problem with the design of a manual marine winch that includes a self releasing handle. The handle includes i) a ratchet gear coupled to the drum wherein rotation of the ratchet gear will cause rotation of the drum, ii) a rotating handle body with a manual end grip, iii) a user engaged trigger mechanism on the end grip moveable between an engaged position and a release position, and iv)

a handle locking pawl on the handle body and coupled to the trigger mechanism and moveable between a position engaged with the ratchet gear rotationally securing the handle body to the ratchet gear and the drum when the trigger is in the engaged position and a position disengaged with the ratchet gear rotationally separating the handle body from the ratchet gear and the drum when the trigger is not in the engaged position. The self-releasing handle of U.S. Patent Application Publication No. 2012-0068132 represents a relatively complex handle and may not be adopted by all winch users.

U.S. Pat. No. 9,004,456 also addresses this issue and discloses a manual marine winch that includes a safety knockout override preventing release of winch tension without the handle in stowed position. The winch includes a housing; a rotating drum on the housing; a winch line on the drum; a control for spooling and un-spooling the winch line on the drum, wherein the control includes a handle for selectively tensioning the drum and moveable between a position engaged with the drum and a disengaged stowed position; a tension holding mechanism on the housing comprising a ratchet gear coupled to the drum, a pawl selectively engaged with the ratchet gear, and a knockout configures to selectively disengage the pawl from the gear to allow for release of winch tension; and a safety knockout override coupled to the housing and selectively engaged by the handle and configured to prevent release of winch tension when the handle is not in the stowed position. Thus there remains a need for preventing undesired handle movement during tension release on manual marine winches with the operation of a knockout device. The safety knockout override of U.S. Pat. No. 9,004,456 also represents a relatively complex design and thus may not be adopted by all winch users.

It is an object of the present invention to minimize the drawbacks of the existing manual winch handles and to provide a simple easy and safe marine winch.

SUMMARY OF THE INVENTION

The various embodiments and examples of the present invention as presented herein are understood to be illustrative of the present invention and not restrictive thereof and are non-limiting with respect to the scope of the invention.

At least some of the above stated objects are achieved with a manual marine winch with a safety loading handle and integrated locking dog release.

One aspect of the invention provides a manual marine winch including a winch housing; a rotating drum assembly supported on the winch housing; and a manually actuated control assembly engaged with the drum assembly for spooling and un-spooling a winch line on the drum assembly, wherein the manually actuated control includes i) a handle for selectively tensioning the drum assembly and moveable between a position engaged with the drum assembly through the control assembly for tensioning of the winch line on the drum assembly and at least one stowed position wherein the handle is not engaged with the drum assembly for tensioning the drum assembly; ii) a tension holding mechanism on the winch comprising at least one tension holding ratchet gear coupled to the drum assembly and at least one locking dog pawl selectively engaged with said at least one tension holding ratchet gear to hold tension on the winch line on the drum assembly, and iii) a knockout member carried on the handle and configured to selectively disengage each of said at least one locking dog pawl from the tension ratchet gears to allow for release of tension on the winch, wherein the knockout member is positioned on the handle to disengage each of said at least one locking dog pawl from the tension holding ratchet gears only when the handle is disengaged from the drum assembly.

Another aspect of the invention provides a manual marine winch comprising a winch housing; a rotating drum assembly supported on the winch housing; a handle for selectively tensioning a winch line on the drum assembly and selectively releasing tension on the winch line on the drum assembly; a tensioning ratchet gear coupled to the drum assembly and configured for selectively tensioning the winch line on the drum assembly; a tensioning ratchet pawl mounted on the handle and selectively engaged with the tensioning ratchet gear for tensioning of the winch line on the drum assembly; at least one tension holding ratchet gear coupled to the drum assembly for holding tension on the winch line on the drum assembly; at least one locking dog pawl selectively engaged with said at least one tension holding ratchet gear to hold tension on the winch line on the drum assembly; and a knockout member carried on the handle and configured to selectively disengage each of said at least one locking dog pawl from the tension holding ratchet gears to allow for release of tension on the winch.

These and other advantages of the present invention will be clarified in the brief description of the preferred embodiment taken together with the drawings in which like reference numerals represent like elements throughout.

DESCRIPTION OF THE PREFERRED EMBODIMENTS

Figure 1:
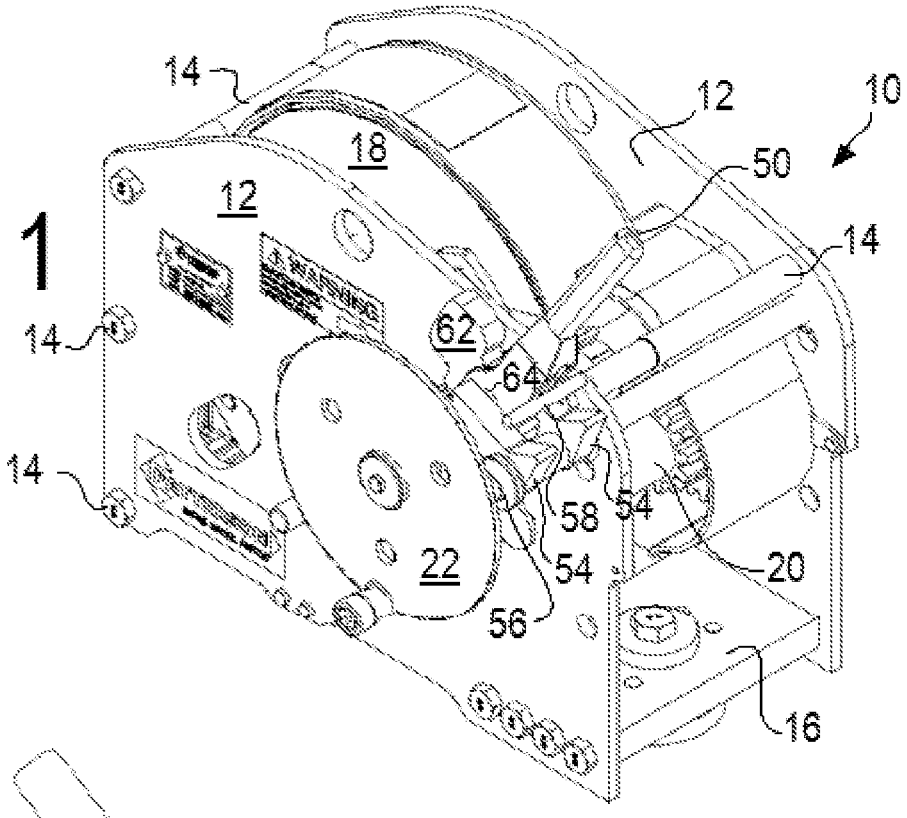
FIG. 1 is perspective view of a manual marine winch with a safety loading handle and integrated locking dog release according to the present invention.

FIG. 1 is perspective view of a manual marine winch 10 with a safety loading handle and integrated locking dog release (referenced collectively as the handle) 50 according to the present invention The manual marine winch 10 includes a pair of spaced side plates 12 with coupling bolt containing tubular spacers 14 and swivel link coupling 16 spacing the side plates 12 apart. Collectively the side plates 12, spacers 14 and even the coupling 16 may be considered to form the winch housing, together with guards and shrouds added for protecting elements.

The side plates 12 encompass a rotatable spool or drum assembly 18. The rotatable spool assembly 18 is rotationally supported between the side plates 12 and includes a drum with a drum gear. The drum of assembly 18 may be formed as a single stack as shown in U.S. Pat. No. 7,543,800 or a back and forth spooling drum as shown in U.S. Pat. No. 5,947,450.

A control assembly 20 is supported by the side plates 12 with gearing that engages with the drum gear to rotate the drum assembly 18 for spooling of a cable (not shown) or wire rope or winch line thereon. The control assembly 20 includes a hand wheel 22 on shaft 24, with the gearing on the shaft 24, for manually rotating the drum assembly and operating the winch 10. The side plates 12, spacers 14, coupling 16, drum assembly 18 and control assembly 20 are generally conventional elements and may be formed as taught in U.S. Pat. Nos. 5,947,450 and 7,543,800, except for the elements of the control assembly 20 described below relating to the safety loading handle 50 and integrated locking dog release 58. Additionally a conventional foot brake (not shown) may be, if desired, attached to the side plate 12 through which the control assembly 20 extends to be adapted to frictionally engage the hand wheel 22.

The unique aspects of the manually actuated control assembly 20 which engages with the drum assembly 18 for spooling and un-spooling a winch line on the drum assembly 18 is centered on the handle 50. The handle 50 is pivotably coupled to shaft 24 and moveable between a forward position shown in FIGS. 2-3 for selectively tensioning the drum assembly 18. In this tensioning position the handle 18 is engaged with the drum assembly 18 through a ratchet pawl 62 engaging a ratchet gear 52 of the control assembly 20 for tensioning of the winch line on the drum assembly 18 as detailed below. The handle 50 is moved to a stowed position shown in FIGS. 4-5 wherein the handle 50 is not engaged with the drum assembly 18 for tensioning the drum assembly 18. Although the mechanism coupling the handle 50 to the drum assembly 18 is slightly different, the tensioning position and motion of the handle is similar to the prior art operations and will be familiar to those in the art.

The winch 10 includes three ratchet wheels 52 on the shaft 24 which are coupled through associated gearing with the drum assembly 18 for rotation of the drum. As mentioned above, one ratchet gear 52, a center tensioning ratchet gear 52, is selectively engaged with a ratchet pawl 62 on the handle 50 for tensioning of the winch line on the drum assembly 18 of the winch 10. Two ratchet wheels 52, tension holding ratchet wheels 52, form part of a tension holding mechanism on the winch 10. Each tension holding ratchet wheel 52 is selectively engaged by a tension holding locking dog pawl 54 pivotably mounted on a shaft 56. One locking dog pawl 54 is selectively engaged with one tension holding ratchet gear 52 to hold tension on the winch line on the drum assembly 18 in a generally conventional fashion. With the locking dog pawl 54 engaged the drum assembly 18 may be further tensioned via wheel 22 or handle 50, but the winch line cannot be payed-out. As shown, the tension holding ratchet gears 52 engaged by the locking dog pawls 54 are circumferentially offset from each other, thus with two tension holding gears 52 offset, then the amount of tensioning movement (of handle 50 or wheel 22) needed to reach the next tension holding level is effectively ½ of the gear spacing of one tension holding ratchet gear 52, which is helpful when reaching high tensions.

Figure 6:
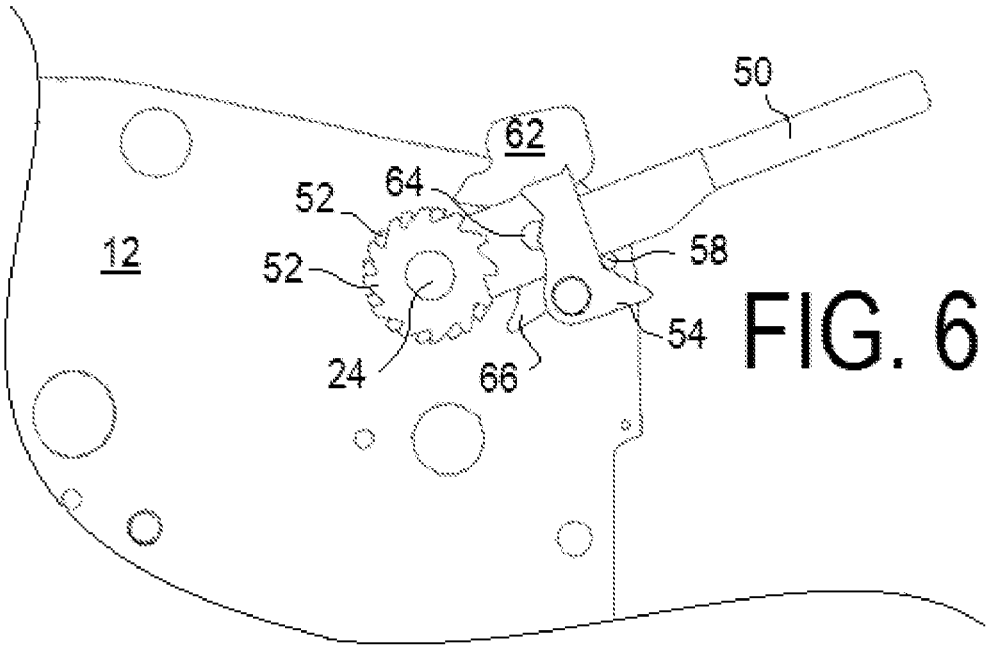
FIG. 6 is a schematic side view of the manual marine winch of FIG. 1 with the safety loading handle and integrated locking dog release in a payout tension releasing position.
Figure 7:
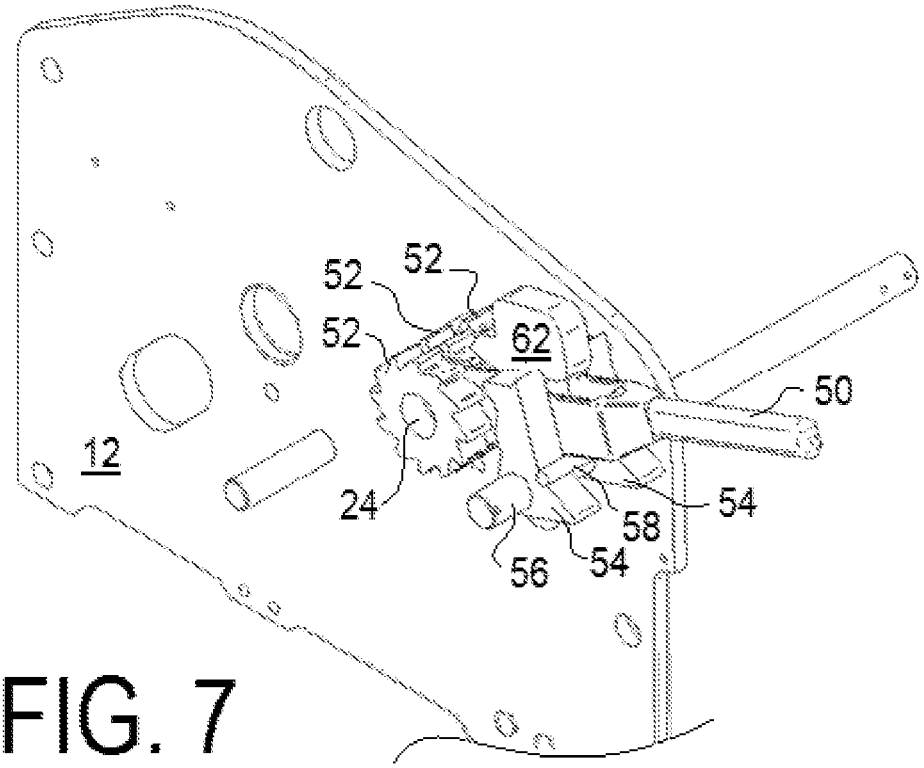
FIG. 7 is a schematic perspective view of the manual marine winch of FIG. 1 with the safety loading handle and integrated locking dog release in the payout tension releasing position shown in FIG. 6.

The marine winch 10 of the present invention includes a knockout member 58 carried on/integrated with the handle 50. The knockout member 58 is configured to selectively disengage each of the locking dog pawls 54 from the tension holding ratchet gears 52 after the handle 50 is moved past the first stored position shown in FIGS. 4-5 in a direction away from the engaged position of FIGS. 2-3 in which the handle 50 may selectively tension the winch line on the drum assembly 18. The knock out member 58 engages with rear ears of the locking dog pawls 54 to move them out of engagement with the tension holding ratchet gears 52 as shown in FIGS. 6-7. The use of a knock out member 58 in general is known to those in the art and the direction of movement is also known. The integration of this aspect with the tensioning handle 50 is novel, but the familiarity of the general action makes this easily understood to the operators.

The handle 50 includes the tensioning ratchet pawl 62 mounted on a pivot 64 on the handle 50 and will swing down and selectively engage with the tensioning ratchet gear 52 that is coupled to the drum assembly 18 for tensioning of the winch as described above. As the handle 50 is moved forward from the locking dog released position or pay-out position of FIGS. 6-7 (second stored position) to the first stored position of FIGS. 4-5, or further to the tensioning position of FIGS. 2-3, the member 58 will move the locking dog pawls 54 on either side of the handle 50 into engagement with the tension holding ratchets 52 to hold tension. Thus the locking dog pawls 54 will be in engagement during tensioning operation of the handle 50.

Figure 2:
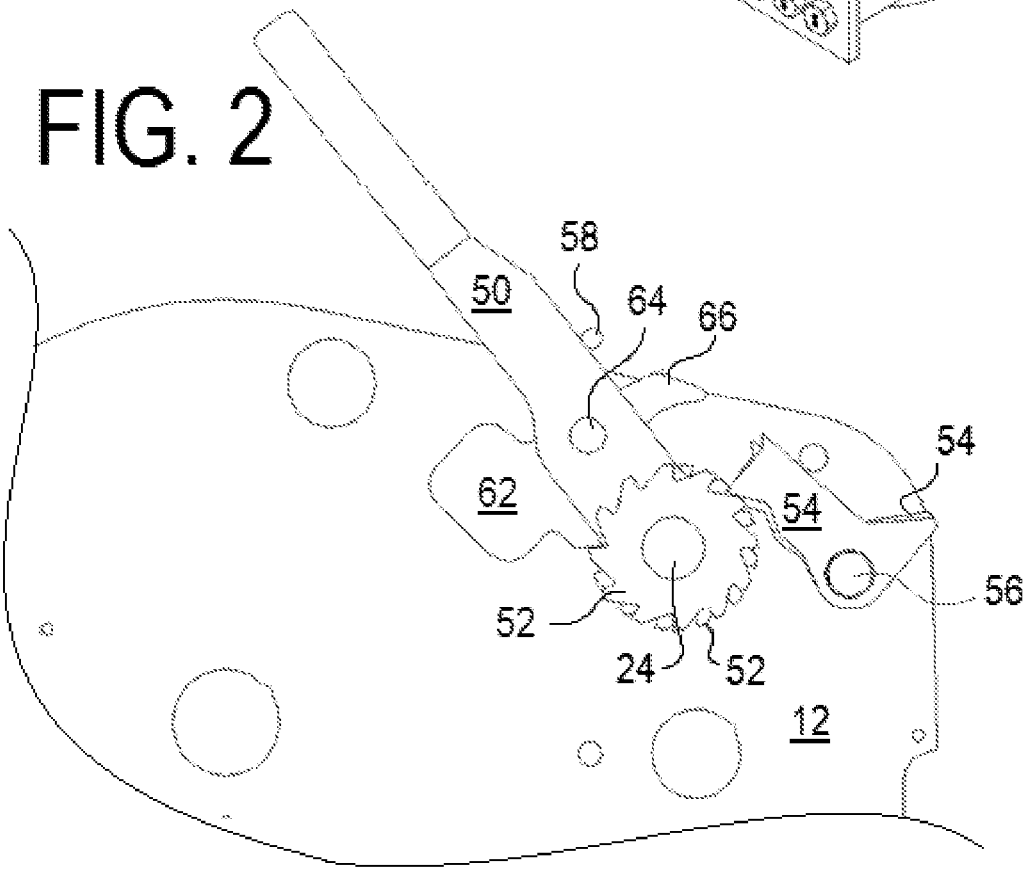
FIG. 2 is a schematic side view of the manual marine winch of FIG. 1 with the safety loading handle and integrated locking dog release in a drum tensioning position.
Figure 3:
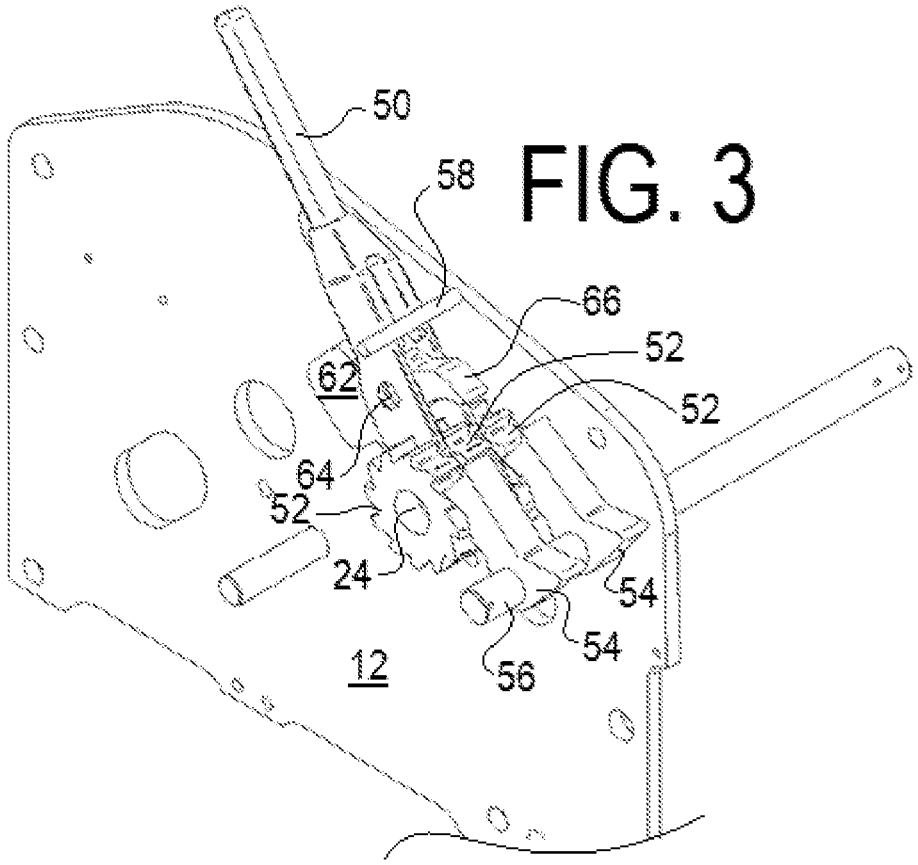
FIG. 3 is a schematic perspective view of the manual marine winch of FIG. 1 with the safety loading handle and integrated locking dog release in the drum tensioning position shown in FIG. 2.
Figure 4:
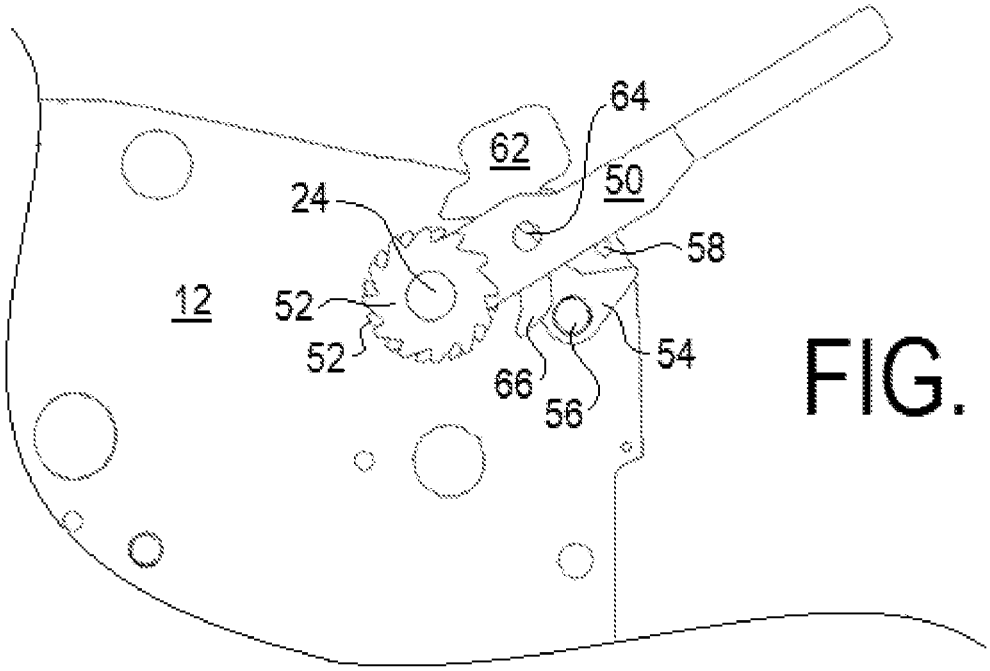
FIG. 4 is a schematic side view of the manual marine winch of FIG. 1 with the safety loading handle and integrated locking dog release in a stowed tension holding position.
Figure 5:
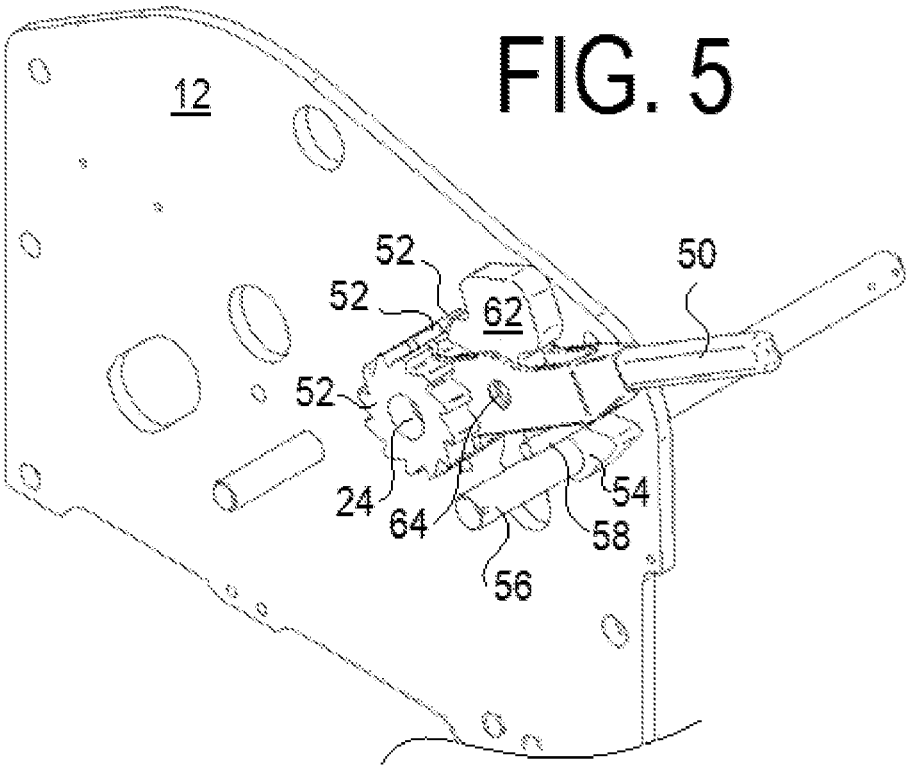
FIG. 5 is a schematic perspective view of the manual marine winch of FIG. 1 with the safety loading handle and integrated locking dog release in the stowed tension holding position shown in FIG. 4.

As the handle is moved from the tensioning position of FIGS. 2-3 to the first stored position of FIGS. 4-5, the tensioning ratchet pawl 62 is configured to pivot out of engagement with the tensioning ratchet gear 52. A rear surface 66 of the tensioning ratchet pawl 62 engages with shaft 56 to pivot the tensioning ratchet pawl 62 as the handle 50 is moved to a first stored position. This assures the tensioning handle 50 is disconnected from the drum assembly 18 when the handle 50 is in the stored position, and, more significantly, when the handle 50 is moved further to disengage the locking dog pawls 54 and release the tension on the winch 10 for pay-out.

The handle 50 of the above describe marine winch 10 thus has a proper stowed position shown in FIGS. 4-5, generally a rearward position, in which it is disengaged from the gearing associated with the drum assembly 18. The stowed position may have a detent member secured to the sidewall or side plate 12 acting as a rest for the handle 50 when in the stowed position, but the handle 50 must be able to be moved rearward past the stowed position of FIGS. 4-5 to disengage the locking dog pawls 54 in the position of FIGS. 6-7 (a second stowed position or a pay-out position). As the handle 50 is rotated forward away from the stowed position of FIGS. 4-5 the tensioning ratchet pawl 62 will engage the tensioning ratchet gear 52 that is coupled to the drum assembly 18 as shown in FIGS. 2-3 to allow for tensioning of the winch line, in a conventional fashion known in the art.

The tension is held on ratchet gears 52 that are engaged with locking dog pawls 54. In conventional tensioning operation for the winch 10, the pawls 54 are engaged with the ratchet gears 52 and the operator will rapidly wind up the winch line, and increase the tension, initially through the operation of the hand wheel 22. Once the tension reaches a relatively high amount on the winch line, the operator will continue the tensioning through the repeated use of the ratchet handle 50 in the tensioning position, often with the use of a handle extension or a "cheater bar" to add increased leverage. Once the final tension is achieved it is intended for the operator to move the handle 50 to the disengaged or stowed position of FIGS. 3-4, typically the rearward position, to prepare the winch for tension release when desired.

The integration of the handle 50 and knockout 58 prevents release of winch tension without the handle 50 in or past the stowed position disengaging the handle 50 from the drum tension according to the present invention. The release of winch tension can be also referenced as "paying out", "unspooling", "unwinding" of the winch line, and is used herein to reference the act of actuating the knock-out member 58 to disengage the locking dog pawls 54 from the gears 52. The drum tension in this release of winch tension may actually be maintained by a foot brake or hand brake or via a secure gripping of the hand wheel by the operator.

The integrated tensioning handle 50 with locking dog knockout member 58 of the present invention can be incorporated into many existing winches. In general the existing tensioning handle, tensioning gear, locking dogs and tension holding gears are replaced with the integrated handle 50, knockout member 58, ratchet gears 52, locking dog pawls 54 and tensioning ratchet pawl 62 of the present invention. The existing shaft 24 of the hand wheel 24 may need to be replaced to accommodate the current structure and a new shaft 56 added to properly position the elements of the invention relative to each other. As a safety consideration it may be desirable to retrofit older winches with these aspects of the present invention.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the present invention is defined in the appended claims and equivalents thereto.

What is claimed is:

1. A manual marine winch comprising:

a winch housing;

a rotating drum assembly supported on the winch housing; and a manually actuated control assembly engaged with the drum assembly for spooling and un-spooling a winch line on the drum assembly, wherein the manually actuated control includes i) a handle for selectively tensioning the drum assembly and moveable between a position engaged with the drum assembly through the control assembly for tensioning of the winch line on the drum assembly and at least one stowed position wherein the handle is not engaged with the drum assembly for tensioning the drum assembly;

ii) a tension holding mechanism on the winch comprising at least one tension holding ratchet gear coupled to the drum assembly and at least one locking dog pawl selectively engaged with said at least one tension holding ratchet gear to hold tension on the winch line on the drum assembly independent of the position of the handle, and iii) a knockout member carried on the handle and configured to selectively disengage each of said at least one locking dog pawl from the tension ratchet gears to allow for release of tension on the winch, wherein the knockout member is positioned on the handle to disengage each of said at least one locking dog pawl from the tension holding ratchet gears only when the handle is disengaged from the drum assembly;

wherein the handle is pivoted between respective positions;

wherein the handle includes a tensioning ratchet pawl mounted on a pivot on the handle and selectively engaged with a tensioning ratchet gear that is coupled to the drum assembly;

wherein the ratchet pawl is configured to engage the tensioning ratchet gear when tensioning the winch line on the drum assembly with the handle;

wherein the tensioning ratchet pawl is configured to pivot out of engagement with the tensioning ratchet gear as the handle is moved to a first stored position;

wherein the knockout member carried on the handle is configured to selectively disengage each of said at least one locking dog pawl from the tension holding ratchet gears after the handle is moved past the first stored position away from the engaged position in which the handle may selectively tension the winch line on the drum assembly;

at least two of the locking dog pawls selectively engaged with at least two of the tension holding ratchet gears.

2. The marine winch of claim 1 wherein the tension holding ratchet gears engaged by the locking dog pawls are circumferentially offset from each other.

3. The marine winch of claim 1 wherein the locking dog pawls are on opposed sides of the handle.

4. The marine winch of claim 3 wherein the tensioning ratchet gear engaged by the tensioning ratchet pawl for selective tensioning is distinct from the tension holding ratchet gears engaged by the locking dog pawls.

5. A manual marine winch comprising:

a winch housing; a rotating drum assembly supported on the winch housing; and a handle for selectively tensioning a winch line on the drum assembly and selectively releasing tension on the winch line on the drum assembly;

a tensioning ratchet gear coupled to the drum assembly and configured for selectively tensioning the winch line on the drum assembly;

a tensioning ratchet pawl mounted on the handle and selectively engaged with the tensioning ratchet gear for tensioning of the winch line on the drum assembly;

at least one tension holding ratchet gear coupled to the drum assembly for holding tension on the winch line on the drum assembly;

at least one locking dog pawl selectively engaged with said at least one tension holding ratchet gear to hold tension on the winch line on the drum assembly independent of the position of the handle; and a knockout member carried on the handle and configured to selectively disengage each of said at least one locking dog pawl from the tension holding ratchet gears to allow for release of tension on the winch;

wherein the handle is pivoted between respective positions;

wherein the tensioning ratchet pawl is mounted on a pivot on the handle;

wherein the tensioning ratchet pawl is configured to engage the tensioning ratchet gear when tensioning the winch line on the drum assembly with the handle;

wherein the tensioning ratchet pawl is configured to pivot out of engagement with the associated ratchet gear as the handle is moved to a first stored position;

wherein the knockout member carried on the handle is configured to selectively disengage each of said at least one locking dog pawl from the ratchet gears after the handle is moved past the first stored position away from the engaged position in which the handle may selectively tension the winch line on the drum assembly;

at least two of the locking dog pawls which are coaxially mounted and selectively engaged with at least two of the ratchet gears which are coaxially mounted.

6. The marine winch of claim 5 wherein the ratchet gears engaged by the locking dog pawls are circumferentially offset from each other.

7. The marine winch of claim 6 wherein the locking dog pawls are on opposed sides of the handle.

8. The marine winch of claim 7 wherein the ratchet gear engaged by the tensioning ratchet pawl for selective tensioning is distinct from the ratchet gears engaged by the locking dog pawls and is coaxially mounted there with.

* * * * *